US009304471B2

(12) United States Patent
Fuke

(10) Patent No.: US 9,304,471 B2
(45) Date of Patent: Apr. 5, 2016

(54) IMAGE FORMING APPARATUS, DISCHARGE TRAY USED IN IMAGE FORMING APPARATUS

(71) Applicant: KYOCERA Document Solutions Inc., Osaka-shi, Osaka (JP)

(72) Inventor: Hikaru Fuke, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/576,053

(22) Filed: Dec. 18, 2014

(65) Prior Publication Data

US 2015/0185676 A1 Jul. 2, 2015

(30) Foreign Application Priority Data

Dec. 26, 2013 (JP) ..... 2013-268886

(51) Int. Cl.

| | |
|---|---|
| ***B65H 31/00*** | (2006.01) |
| ***G03G 15/00*** | (2006.01) |
| ***G03G 21/20*** | (2006.01) |
| ***B65H 31/02*** | (2006.01) |

(52) U.S. Cl.

CPC ..... *G03G 15/6552* (2013.01); *B65H 31/02* (2013.01); *G03G 21/206* (2013.01); *B65H 2301/4212* (2013.01); *B65H 2301/5144* (2013.01); *B65H 2405/113* (2013.01); *B65H 2405/11151* (2013.01); *B65H 2405/1412* (2013.01); *B65H 2406/352* (2013.01)

(58) Field of Classification Search

CPC .... B65H 29/00; B65H 31/00; B65H 2405/11; B65H 2406/121; B65H 2406/122; B65H 31/02; B65H 2405/113; B65H 2405/11151; B65H 2405/1412; B65H 2406/11151; B65H 2406/352; B65H 2301/4212; B65H 2301/5144; G03G 15/6552; G03G 21/206

USPC ..... 271/207, 211

See application file for complete search history.

(56) References Cited

U.S. PATENT DOCUMENTS 6,522,841 B2 * 2/2003 Horikoshi ..... 399/45

FOREIGN PATENT DOCUMENTS

JP 2009288742 A 12/2009

* cited by examiner

*Primary Examiner* — David H Bollinger

(74) *Attorney, Agent, or Firm* — Alleman Hall McCoy Russell & Tuttle LLP

(57) ABSTRACT

An image forming apparatus includes a discharge tray, a plurality of ribs, a ventilation duct, a ventilation hole, and an air flow generating portion. On the discharge tray, a sheet having been subjected to a fixing process for thermally fixing a toner image on the sheet is discharged. The plurality of ribs are formed on the discharge tray. The ventilation duct is formed on a side of an end among opposite ends of each of the plurality of ribs. The ventilation hole is formed in a partition wall separating the ventilation duct from a sheet mounting area of the discharge tray, and formed in a vicinity of the end of each of the plurality of ribs on the partition wall side. The air flow generating portion is configured to generate, via the ventilation duct, air flow between outside of an apparatus main body and spaces between the ribs.

11 Claims, 12 Drawing Sheets

IMAGE FORMING APPARATUS, DISCHARGE TRAY USED IN IMAGE FORMING APPARATUS

INCORPORATION BY REFERENCE

This application is based upon and claims the benefit of priority from the corresponding Japanese Patent Application No. 2013-268886 filed on Dec. 26, 2013, the entire contents of which are incorporated herein by reference.

BACKGROUND

The present disclosure relates to an image forming apparatus having a function to, in a discharge tray on which a sheet after an image forming process is discharged, cool the high-temperature sheet discharged on the discharge tray by generating air flows along a sheet mounting surface.

There is known, for example, a technology aimed to, in an image forming apparatus, prevent the inside of the apparatus from being adversely affected by heat of high-temperature sheets discharged on the discharge tray.

Specifically, a typical image forming apparatus includes an intake fan for taking external air into the apparatus. A plurality of ribs extending in the sheet discharge direction are formed at constant intervals on the discharge tray of the image forming apparatus. In addition, a plurality of exhaust outlets are provided in the vicinity of ends of the ribs on the upstream side in the sheet discharge direction. The plurality of exhaust outlets are each provided between adjacent ribs. The intake fan allows the air it has taken into the apparatus, to be exhausted from the exhaust outlets to spaces between adjacent ribs. This allows heat to be exchanged between the high-temperature sheets discharged on the discharge tray and the air that passes through the spaces between the ribs, thereby the sheets are cooled.

SUMMARY

An image forming apparatus according to an aspect of the present disclosure includes a discharge tray, a plurality of ribs, a ventilation duct, a ventilation hole, and an air flow generating portion. On the discharge tray, a sheet having been subjected to a fixing process for thermally fixing a toner image on the sheet is discharged. The plurality of ribs are formed on the discharge tray. The ventilation duct is formed on a side of an end among opposite ends of each of the plurality of ribs. The ventilation hole is formed in a partition wall separating the ventilation duct from a sheet mounting area of the discharge tray, and formed in a vicinity of the end of each of the plurality of ribs on the partition wall side. The air flow generating portion is configured to generate, via the ventilation duct, air flow between outside of an apparatus main body and spaces between the ribs.

A discharge tray according to another aspect of the present disclosure includes a sheet mounting surface, a plurality of ribs, a partition wall, and a ventilation hole. The sheet mounting surface has a sheet mounting area on which a sheet having been subjected to a fixing process for thermally fixing a toner image on the sheet is placed. The plurality of ribs are formed on the sheet mounting surface. The partition wall is configured to separate the sheet mounting area from a ventilation duct formed on a side of an end among opposite ends of each of the plurality of ribs. The ventilation hole is formed in the partition wall in a vicinity of the end of each of the plurality of ribs on the partition wall side.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
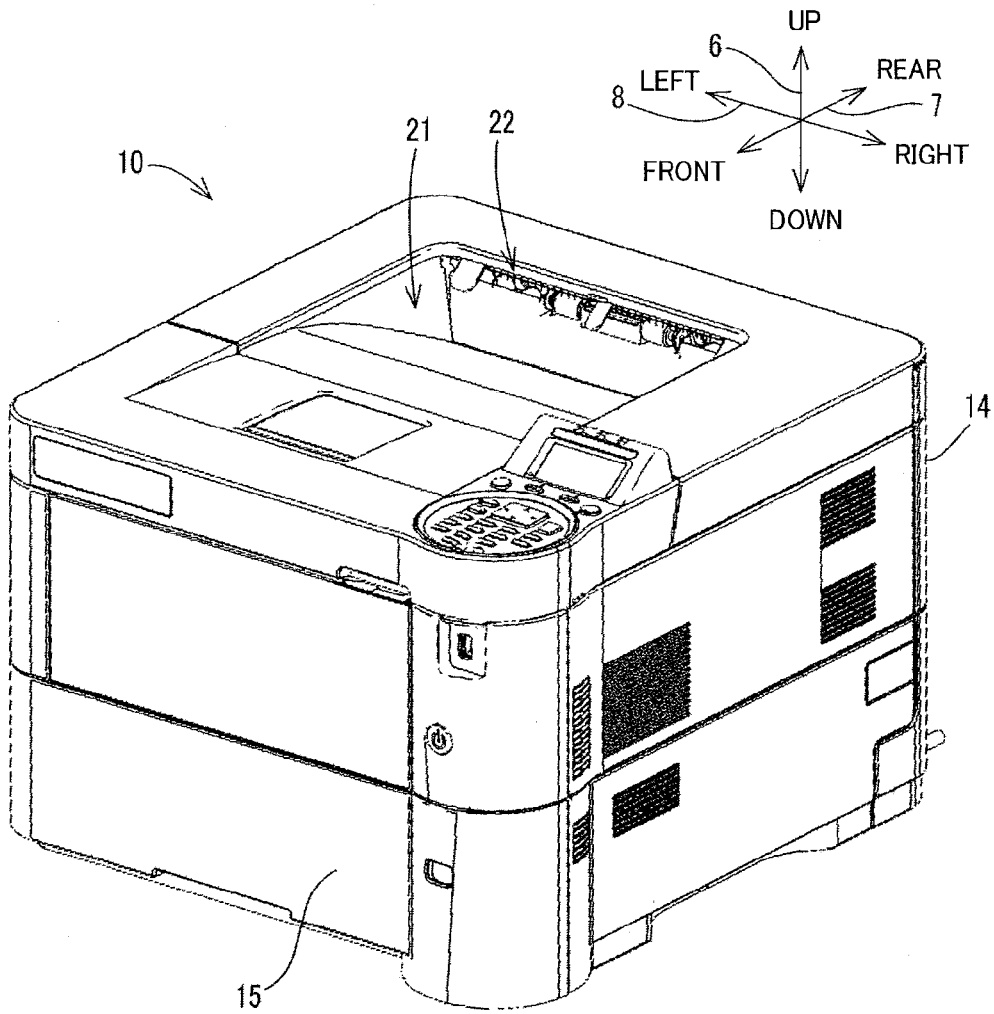
FIG. 1 is a perspective view showing the configuration of the image forming apparatus according to an embodiment of the present disclosure.
Figure 2:
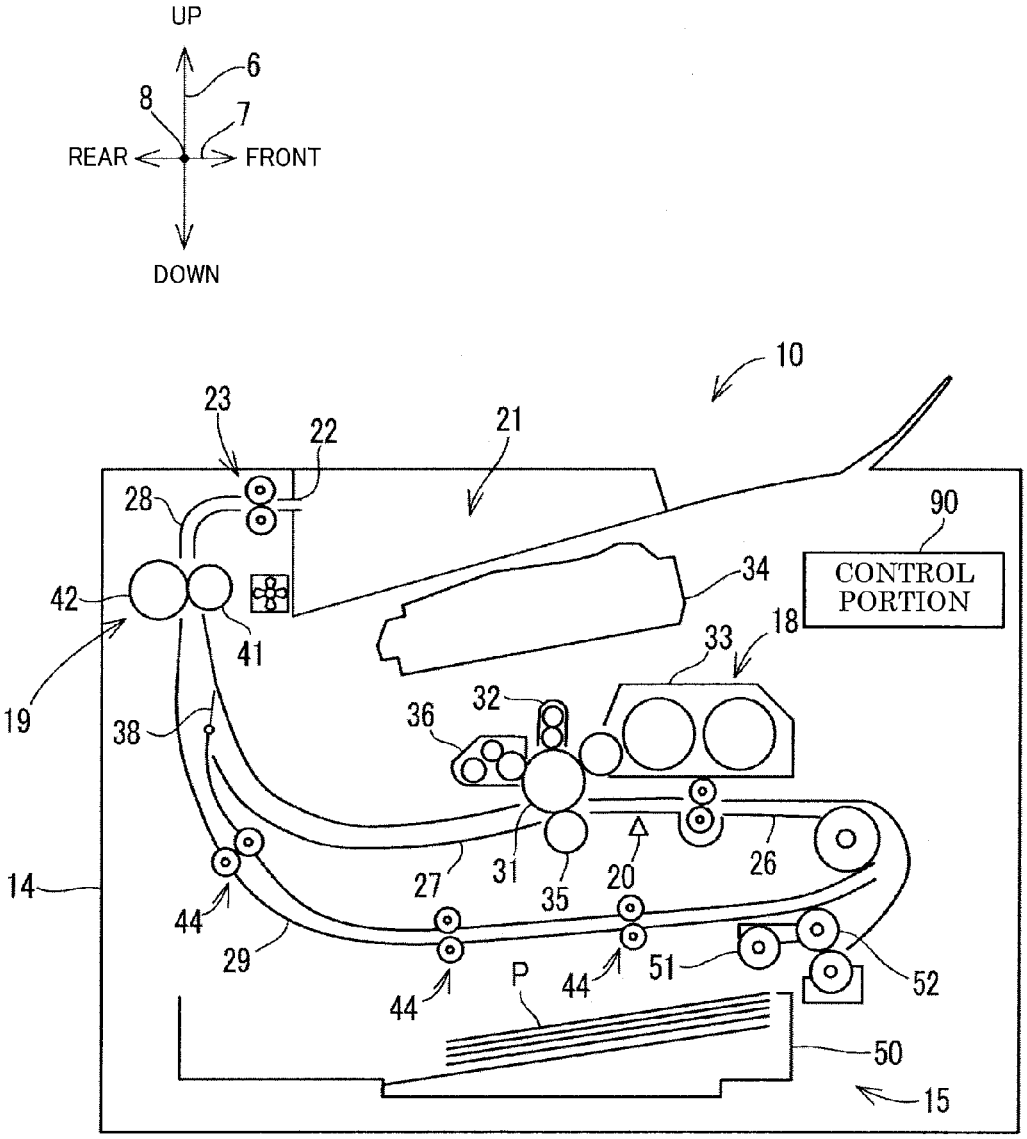
FIG. 2 is a diagram showing the internal configuration of the image forming apparatus according to an embodiment of the present disclosure.

The following describes an embodiment of the present disclosure with reference to the drawings. FIGS. 1 and 2 are schematic configuration diagrams showing the configuration of an image forming apparatus 10 in the embodiment of the present disclosure.

The image forming apparatus 10 shown in FIGS. 1 and 2 is an example of the image forming apparatus of the present disclosure. In the following description, an up-down direction 6 is defined on the basis of the state (the state shown in FIG. 1) where the image forming apparatus 10 is usably installed. In addition, a front-rear direction 7 is defined on the supposition that the nearer side (front side) of the image forming apparatus 10 is "front", and a left-right direction 8 is defined to indicate the left and right when viewed from the nearer side (front side) of the image forming apparatus 10.

As shown in FIG. 1, the image forming apparatus 10 is a printer. The image forming apparatus 10 prints input image data on a print sheet P (an example of the sheet) made from vegetable fibers such as pulps, by using a print material such as toner. It is noted that the image forming apparatus 10 is not limited to a printer, and the present disclosure is applicable to a facsimile and a copier, as well. In addition, the present disclosure is applicable to a multifunction peripheral having a plurality of functions such as a print function, a facsimile function, and a copy function.

The image forming apparatus 10 prints an image on a print sheet P based on image data input from outside via a network communication portion (not shown). For example, upon receiving a print job transferred from an apparatus such as a personal computer, the image forming apparatus 10 prints an image on the print sheet P based on image data and print conditions included in the print job. Alternatively, the image forming apparatus 10 prints an image on the print sheet P based on image data read by a scanner (not shown).

As shown in FIG. 2, the image forming apparatus 10 includes, as the major components, an image forming portion 18 of the electrophotography, a fixing portion 19, a sheet feed device 15, a paper sheet sensor 20, and a control portion 90 for comprehensively controlling the image forming apparatus 10. These are provided in a housing 14 that forms an apparatus main body of the image forming apparatus 10.

As shown in FIG. 2, the sheet feed device 15 is provided in the lowest part of the image forming apparatus 10. The sheet feed device 15 includes a paper sheet tray 50, a pick-up roller 51, and a conveying roller 52. On the paper sheet tray 50, print sheets P on which images are to be formed by the image forming portion 18 are stacked. The paper sheet tray 50 is supported by the housing 14. The pick-up roller 51 and the conveying roller 52 are provided on the front side above the paper sheet tray 50. When an instruction to start feeding the print sheet P is input to the image forming apparatus 10, a conveying motor (not shown) is rotationally driven. This allows the pick-up roller 51 and the conveying roller 52 to be rotated. Subsequently, a print sheet P is fed from the paper sheet tray 50 by the pick-up roller 51. The print sheet P fed by the pick-up roller 51 is conveyed by the conveying roller 52 toward the downstream in the print sheet P conveying direction. Specifically, the print sheet P fed by the conveying roller 52 upward passes through a conveyance path 26 in which the coveying direction is changed and the print sheet P is conveyed rearward, and conveyed to the image forming portion 18, wherein the conveyance path 26 extends from the conveying roller 52 to the image forming portion 18.

A paper sheet sensor 20 is provided in the conveyance path 26. Specifically, the paper sheet sensor 20 is disposed before a transfer portion 35 of the image forming portion 18 in the conveyance path 26. The paper sheet sensor 20 is used to detect the front end of a print sheet P passing through the conveyance path 26, and is, for example, an optical sensor of a light projection type. When the front end of a print sheet P passes a position in the conveyance path 26 that corresponds to the disposed position of the paper sheet sensor 20, a signal output from the paper sheet sensor 20 to the control portion 90 changes. Upon receiving a change of the signal, the control portion 90 can determine the position of the front end of the print sheet P.

The image forming portion 18 forms an image on the print sheet P based on the input image data. The image forming portion 18 transfers a toner image onto the print sheet P by using a print material such as toner. Specifically, as shown in FIG. 2, the image forming portion 18 includes a photoconductor drum 31, a charging portion 32, a developing portion 33, an LSU (Laser Scanning Unit) 34 as the optical scanning device, a transfer portion 35, and a cleaning portion 36.

The photoconductor drum 31 is provided above the conveyance path 26. When the image forming operation is started, the charging portion 32 charges the surface of the photoconductor drum 31 to a uniform potential. In addition, the LSU 34 scans the photoconductor drum 31 with laser light based on the image data. This allows an electrostatic latent image to be formed on the photoconductor drum 31. Subsequently, the developing portion 33 causes toner to be adhered to the electrostatic latent image, thereby a toner image is formed on the photoconductor drum 31. The transfer portion 35 transfers the toner image to the print sheet P conveyed in the conveyance path 26. The print sheet P with the toner image transferred thereto is fed into a conveyance path 27 that is formed between the image forming portion 18 and the fixing portion 19. The print sheet P is then conveyed to the fixing portion 19 that is disposed more on the downstream side (i.e., the rear side) in the conveyance direction of the print sheet P than the image forming portion 18.

The fixing portion 19 performs a fixing process onto the print sheet P, wherein in the fixing process it fixes the toner image having been transferred to the print sheet P, to the print sheet P by heat. The fixing portion 19 includes a heating roller 41 and a pressure roller 42. The pressure roller 42 is biased toward the heating roller 41 by an elastic member such as a spring. This causes the pressure roller 42 to be pressed against the heating roller 41. The heating roller 41 is heated to a high temperature by a heating means such as a heater, during the fixing operation. When the print sheet P passes through the fixing portion 19, the toner forming the toner image is heated and fused by the heating roller 41 while the print sheet P is pressed by the pressure roller 42. As a result, the toner is fixed to the print sheet P by the fixing portion 19. Accordingly, the toner image is fixed to the print sheet P, and an image is formed on the print sheet P.

A conveyance path 28 is formed on the downstream side of the fixing portion 19 in the conveyance direction of the print sheet P. A paper sheet discharge outlet 22 is provided at an end of the conveyance path 28. That is, the conveyance path 28 extends from the fixing portion 19 to the paper sheet discharge outlet 22. The print sheet P to which the image was fixed by the fixing portion 19 is conveyed to the conveyance path 28. The conveyance path 28 is curved upward from the fixing portion 19, and then extends in the horizontal direction. In the conveyance path 28, a pair of discharge rollers 23 are provided on the upstream side of the paper sheet discharge outlet 22 in the conveyance direction. The print sheet P having been conveyed to the conveyance path 28 is conveyed upward through the conveyance path 28 by the pair of discharge rollers 23 that are rotated in the forward direction, and is discharged from the paper sheet discharge outlet 22 onto a discharge tray 21 provided on the upper surface of the image forming apparatus 10.

When the single side printing is performed in the image forming apparatus 10, a print sheet P with an image formed on a side thereof is passed through the fixing portion 19, is conveyed in the conveyance path 28, and is discharged from the paper sheet discharge outlet 22.

On the other hand, when the double side printing is performed in the image forming apparatus 10, first a print sheet P with an image formed on a side thereof is passed through the fixing portion 19, the front and rear are reversed, and is conveyed again in the reverse direction from the upstream side in the conveyance direction of the print sheet P. Specifically, the pair of discharge rollers 23 near the paper sheet discharge outlet 22 are stopped in the state where the front end of the print sheet P, with an image formed on a side thereof, is exposed from the paper sheet discharge outlet 22 to outside. At this time, the print sheet P is held in the state where the rear end thereof is nipped by the pair of discharge rollers 23. Then, the pair of discharge rollers 23 are rotated in the reverse direction. This causes the print sheet P to be conveyed again in the conveyance path 28 in the reverse direction. That is, the print sheet P is conveyed backward in the conveyance path 28.

As shown in FIG. 2, the image forming apparatus 10 includes a reverse conveyance path 29 that branches from the conveyance path 28 and connects to the conveyance path 26 that is positioned on the upstream side in the conveyance direction of the print sheet P when viewed from the image forming portion 18. At a branch point between the conveyance path 28 and the reverse conveyance path 29, a film-shaped flap 38 is provided to guide the print sheet P conveyed backward to the reverse conveyance path 29. The print sheet P conveyed backward is guided by the flap 38 from the conveyance path 28 to the reverse conveyance path 29. A plurality of pairs of conveying rollers 44 are provided in the reverse conveyance path 29. The print sheet P is passed through the reverse conveyance path 29 by the pairs of conveying rollers 44 and is conveyed to the image forming portion 18 again via the conveyance path 26. The print sheet P having reached the image forming portion 18 passes through the image forming portion 18 and the fixing portion 19, thereby an image is formed on the opposite side of the print sheet P on which no image has been formed. Subsequently, the print sheet P with images formed on both sides thereof is conveyed in the conveyance path 28 by the pair of discharge rollers 23 that have been returned to the forward rotation, and then discharged onto the discharge tray 21 from the paper sheet discharge outlet 22. In this way, the reverse conveyance path 29 and the pairs of conveying rollers 44 reverse the front and rear of the print sheet P and convey it to the upstream side of the image forming portion 18 again.

The print sheet P discharged onto the discharge tray 21 has been heated to a high temperature in the fixing process performed by the fixing portion 19. The heat of the print sheet P is transmitted to the discharge tray 21, and transmitted from the discharge tray 21 to various portions in the apparatus. It is concerned that this may cause deformation of optical parts or aggregation of toner. In particular, according to the present embodiment, as shown in FIG. 2, the LSU 34 is positioned immediately below the discharge tray 21. As shown in FIG. 2, in addition to the conveyance path 26 and the conveyance path 28, the reverse conveyance path 29 in which the print sheet P is conveyed during the double side printing is formed between the sheet feed device 15 and the image forming portion 18. As a result, the setting position of the LSU 34 in the housing 14 is restricted, and the LSU 34 is disposed immediately below the discharge tray 21. Although not shown, the LSU 34 includes a light beam generator, a polygon mirror, a polygon motor, a control board, and optical parts. The light beam generator generates a light beam (laser beam). The polygon mirror is a mirror that is hexagonal or the like and deflects the light beam irradiated from the light beam generator. The polygon motor rotationally drives the polygon mirror. The control board is a board supporting the polygon motor and mounting electronic parts such as an IC thereon. The optical parts include an image forming lens (fθ lens) and the like, wherein the image forming lens forms, on the photoconductor drum 31, an image of the light beam deflected by the polygon mirror. When heat is transmitted from the discharge tray 21 to the above-described LSU 34, for example, a housing (not shown) made of resin and storing the LSU 34 is heated and thermally deformed. This thermal deformation shifts the relative positions of the optical parts disposed in the housing, and due to the shift, the accuracy of the exposing position with respect to the circumferential surface of the photoconductor drum 31 is decreased. In view of this, in the present embodiment, the following configuration is adopted.

Figure 3:
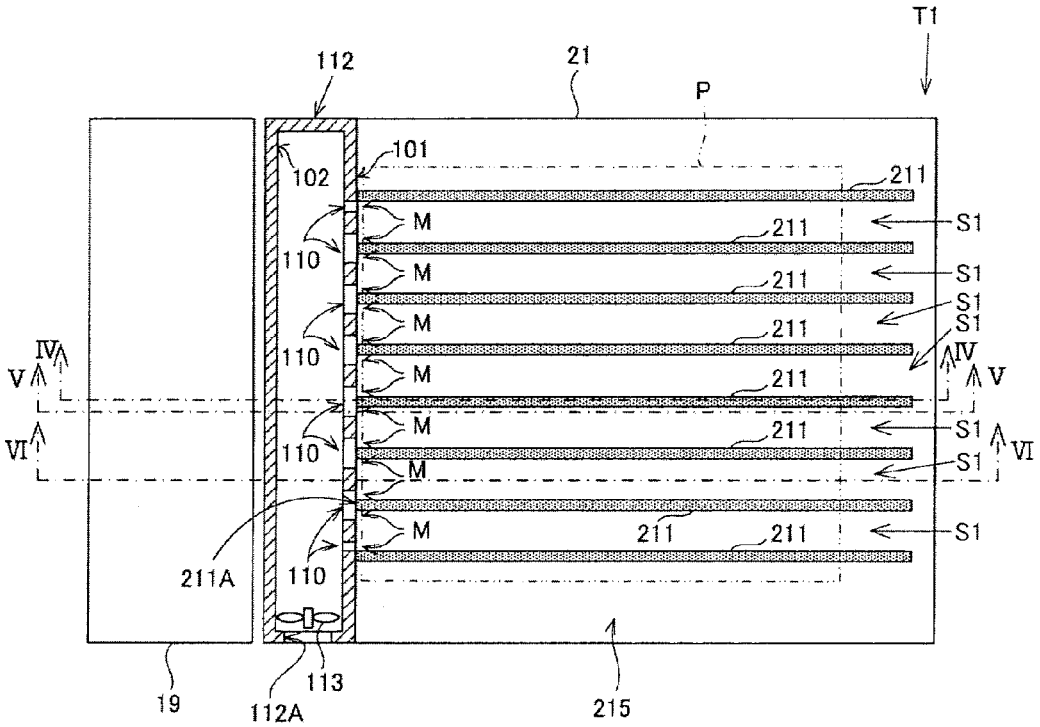
FIG. 3 is a plan view showing the configuration of the peripheral of the discharge tray.
Figure 4:
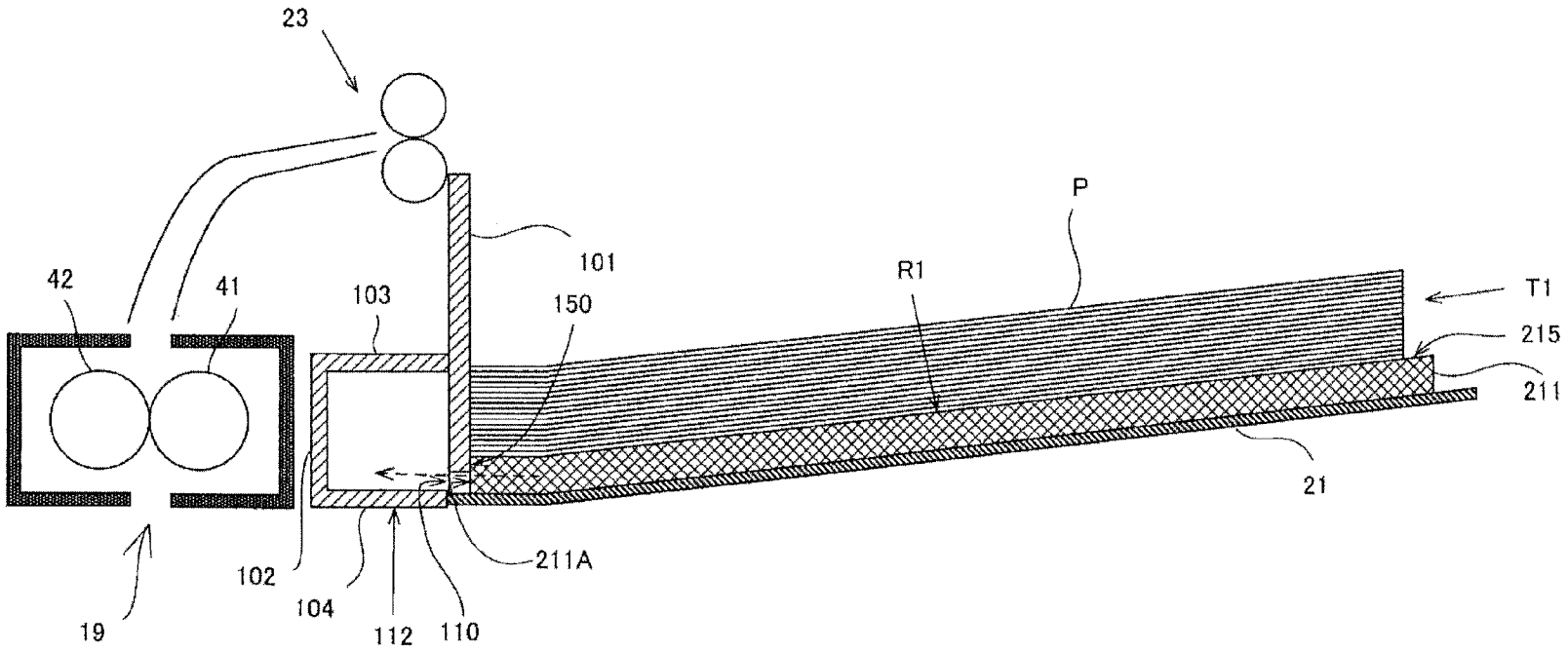
FIG. 4 is a cross-sectional view taken along the IV-IV line of FIG. 3.
Figure 5:
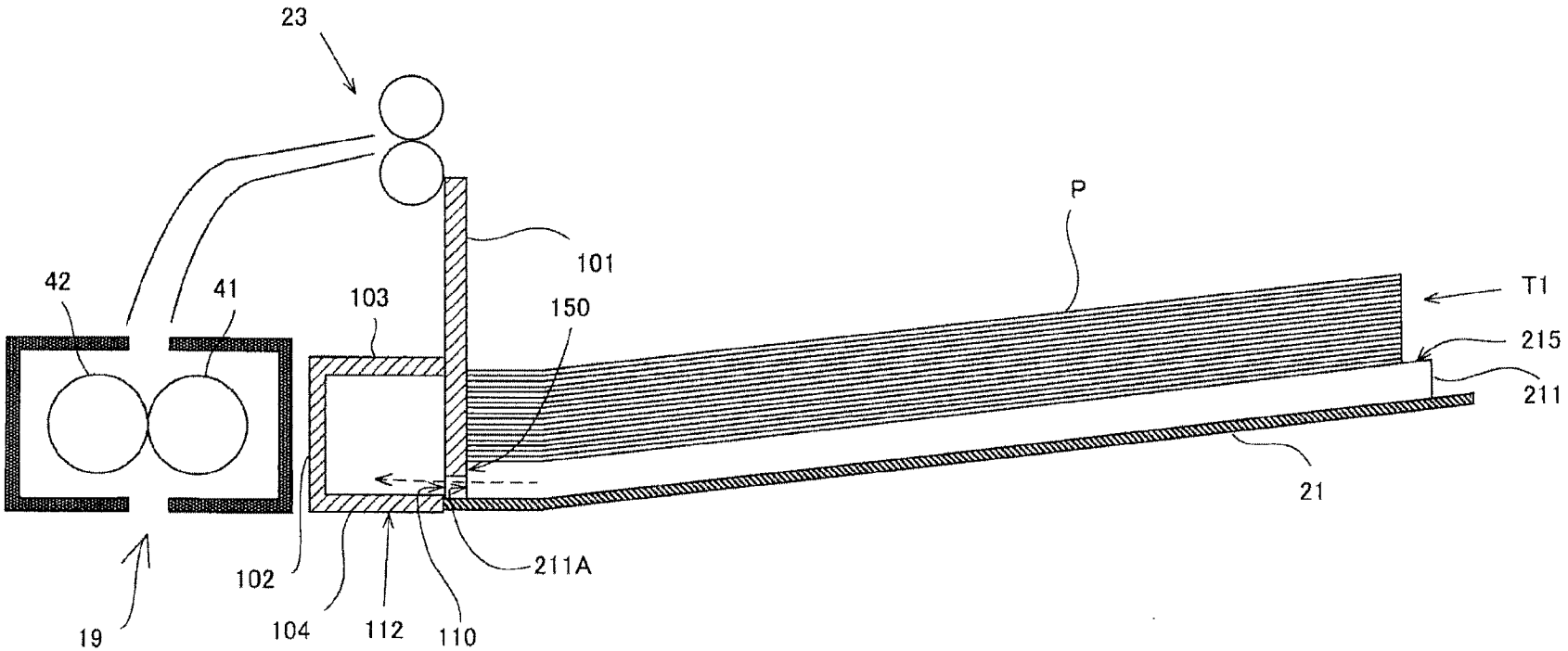
FIG. 5 is a cross-sectional view taken along the V-V line of FIG. 3.
Figure 6:
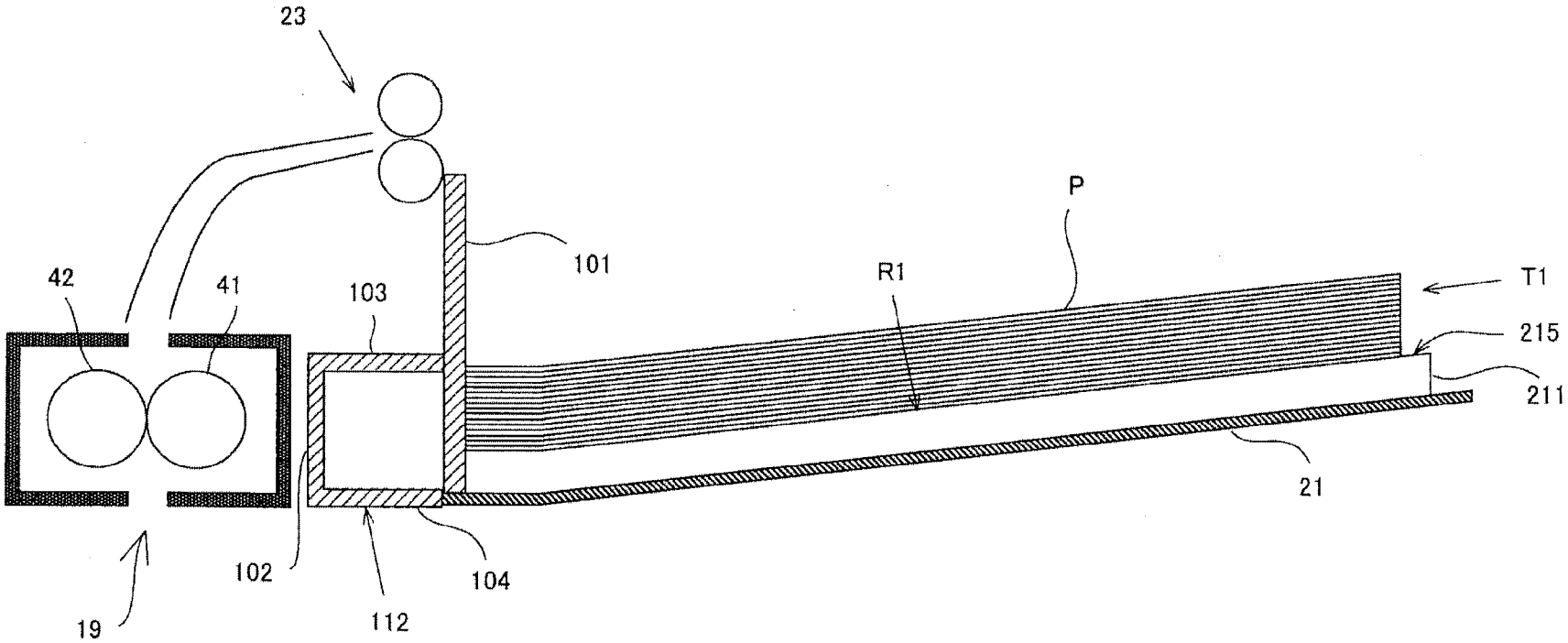
FIG. 6 is a cross-sectional view taken along the VI-VI line of FIG. 3.

FIG. 3 is a plan view showing the configuration of the peripheral of the discharge tray 21. It is noted that, in FIG. 3, some members (e.g., a ventilation duct 112) are shown in a cross section. FIG. 4 is a cross-sectional view taken along the IV-IV line of FIG. 3. FIG. 5 is a cross-sectional view taken along the V-V line of FIG. 3. FIG. 6 is a cross-sectional view taken along the VI-VI line of FIG. 3.

As shown in FIGS. 3 and 4, each print sheet P having been subjected to the fixing process is discharged onto the upper surface (sheet mounting surface) of the discharge tray 21, as described above. When a plurality of print sheets P are discharged continuously onto the discharge tray 21, those print sheets P are stacked on a sheet mounting area 215 defined on the upper surface of the discharge tray 21.

On the discharge tray 21, a plurality of ribs 211 (an example of the ribs of the present disclosure) extending in a sheet discharge direction are formed. The plurality of ribs 211 are aligned at constant intervals in a direction perpendicular to the sheet discharge direction (the left-right direction in FIG. 3). As a result, a space S1 is formed between each pair of adjacent ribs 211.

Figure 7:
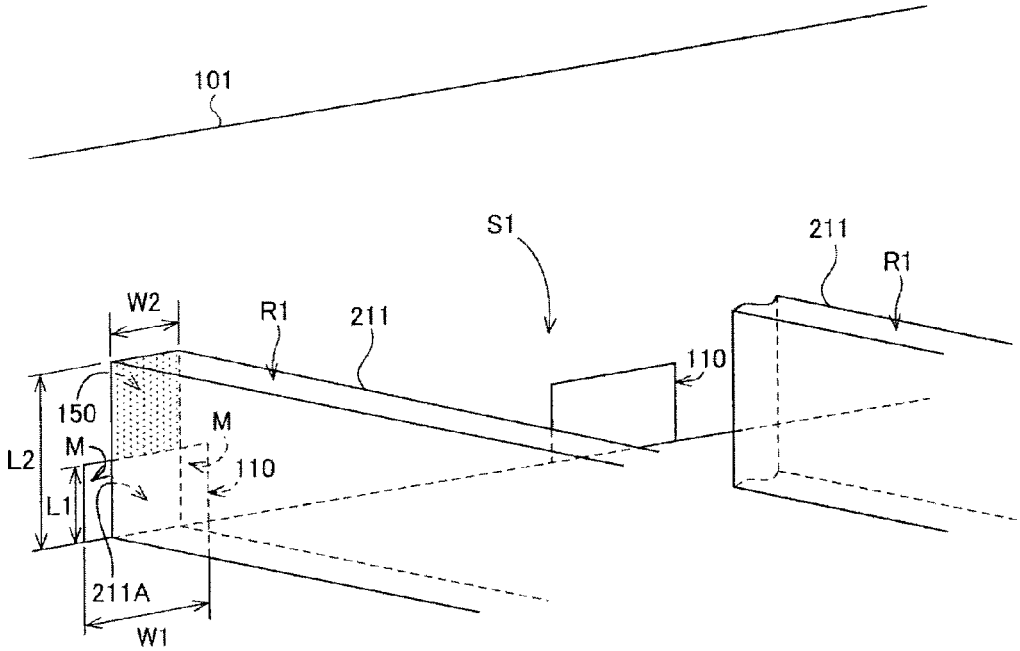
FIG. 7 is a perspective view showing the positional relationship between the ribs and the first vertical partition wall.

In the image forming apparatus 10 of the present embodiment, the fixing portion 19 and the discharge tray 21 are provided at approximately the same height. In addition, as shown in FIGS. 3 to 6, the fixing portion 19 and the discharge tray 21 are separated by a first vertical partition wall 101. The first vertical partition wall 101 is an example of the partition wall of the present disclosure. The first vertical partition wall 101 may be integral with the discharge tray 21, or may be an independent member separate from the discharge tray 21. The first vertical partition wall 101 separates the inside (specifically, the peripheral of the fixing portion 19) of the image forming apparatus 10 from the sheet mounting area 215 of the discharge tray 21. As shown in FIG. 7, each rib 211 contacts the first vertical partition wall 101 at right angle at a contact portion 150 (indicated by hatching in FIG. 7), and they are joined at the contact portions 150. It is noted that the paper sheet discharge outlet 22 is provided at a predetermined position of the first vertical partition wall 101.

As shown in FIGS. 4 to 6, a ventilation duct 112 is proved between the fixing portion 19 and the discharge tray 21. In the present embodiment, the ventilation duct 112 is formed by using the first vertical partition wall 101. That is, a part of the first vertical partition wall 101 serves as one wall of the ventilation duct 112. The ventilation duct 112 includes the first vertical partition wall 101, a second vertical partition wall 102, a first horizontal partition wall 103, and a fourth horizontal partition wall 104. The second vertical partition wall 102 is erected at a predetermined interval from the first vertical partition wall 101. The first horizontal partition wall 103 connects the top end of the first vertical partition wall 101 and the top end of the second vertical partition wall 102. The fourth horizontal partition wall 104 connects the bottom end of the first vertical partition wall 101 and the bottom end of the second vertical partition wall 102. The ventilation duct 112 is formed in a shape of a square cylinder with a hollow rectangle formed by the partition walls 101 to 104 in cross section.

As shown in FIG. 3, the first vertical partition wall 101 constituting a part of the ventilation duct 112 forms a right angle with the ribs 211 formed on the discharge tray 21. At an end of the ventilation duct 112 in the longitudinal direction, an exhaust outlet 112A is formed to communicate the inside of the ventilation duct 112 with the outside of the housing 14 (outside of the apparatus main body). In addition, an exhaust fan 113 (an example of the air flow generating portion of the present disclosure) is provided inside the ventilation duct 112 in the vicinity of the exhaust outlet 112A. The exhaust fan 113 discharges air from inside of the ventilation duct 112 to outside of the housing 14 via the exhaust outlet 112A.

As shown in FIGS. 3 to 5, a plurality of ventilation holes 110 are formed to communicate the spaces 51 between the ribs 211 with the inside of the ventilation duct 112. The ventilation holes 110 are formed respectively in the vicinity of ends 211A which are ends of the ribs 211 on the first vertical partition wall 101 side.

Specifically, as shown in FIG. 7, a width W1 of the ventilation holes 110 is larger than a width W2 of the ribs 211. The ventilation holes 110 are formed such that the center in the width direction of each ventilation hole 110 corresponds to the center in the width direction of a corresponding rib 211. As a result, when the first vertical partition wall 101 is viewed from the rib 211 side, it can be seen that openings M are formed on both sides of each rib 211 in the width direction. In addition, a height L1 of the ventilation holes 110 is set lower than a height L2 of the ribs 211. It is noted that, with regard to a rib 211 shown on the right-hand side in FIG. 7, the peripheral of the end 211A on the first vertical partition wall 101 side is broken.

As shown in FIG. 3, when the exhaust fan 113 operates in the state where discharged print sheets P are stacked on the discharge tray 21, negative pressure is generated in each space S1 surrounded by the adjacent ribs 211 and the print sheets P. As a result, as shown in FIGS. 3 to 5, air flows into each space S1 from an end T1 (see FIG. 3) of the discharge tray 21 opposite to the first vertical partition wall 101. The air enters the ventilation duct 112 via the ventilation holes 110 (the openings M). Furthermore, the air flows through the ventilation duct 112 toward the exhaust fan 113, and is discharged outside of the housing 14 by the exhaust fan 113.

Figure 8:
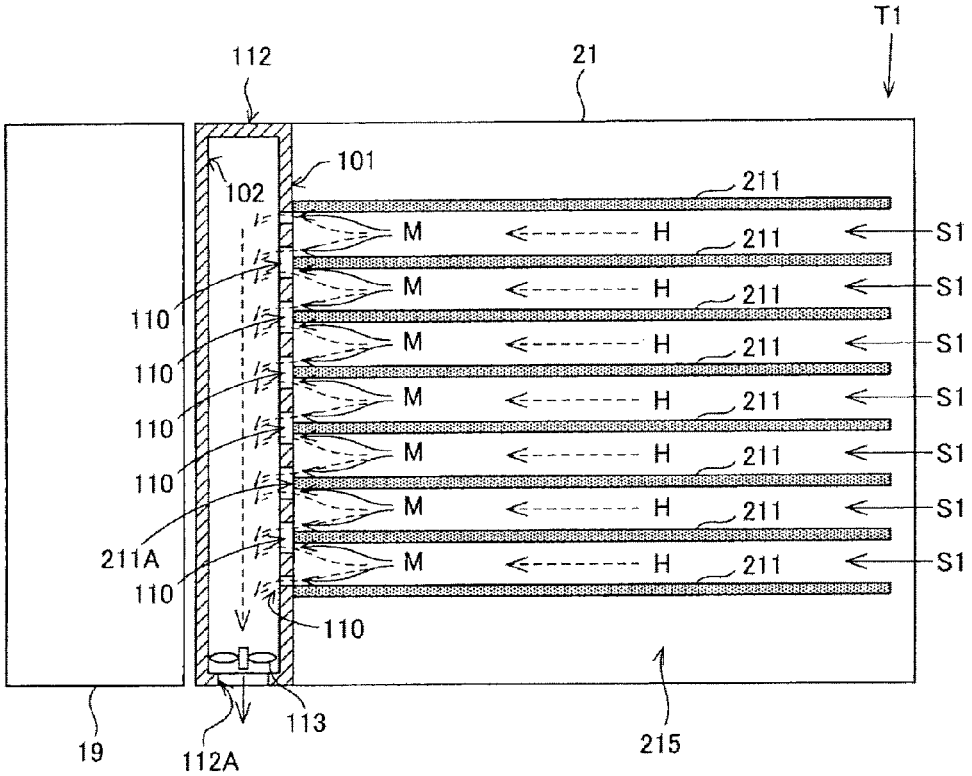
FIG. 8 is an explanatory diagram of the air flow.

As described above, when the exhaust fan 113 operates, as the arrows H in FIG. 8 indicate, an air flow is generated in such a manner that air enters the apparatus main body from outside, flows through the spaces S1, the ventilation holes 110, and the ventilation duct 112, and is exhausted to the outside of the apparatus main body again by the exhaust fan 113. The air flow replaces the air within the spaces S1. That is, the air flow replaces the air in the spaces S1 that includes heat released from the discharge tray 21 and high-temperature print sheets P discharged onto the discharge tray 21. This allows the print sheets P and the discharge tray 21 to be cooled (heat is released).

Figure 9:
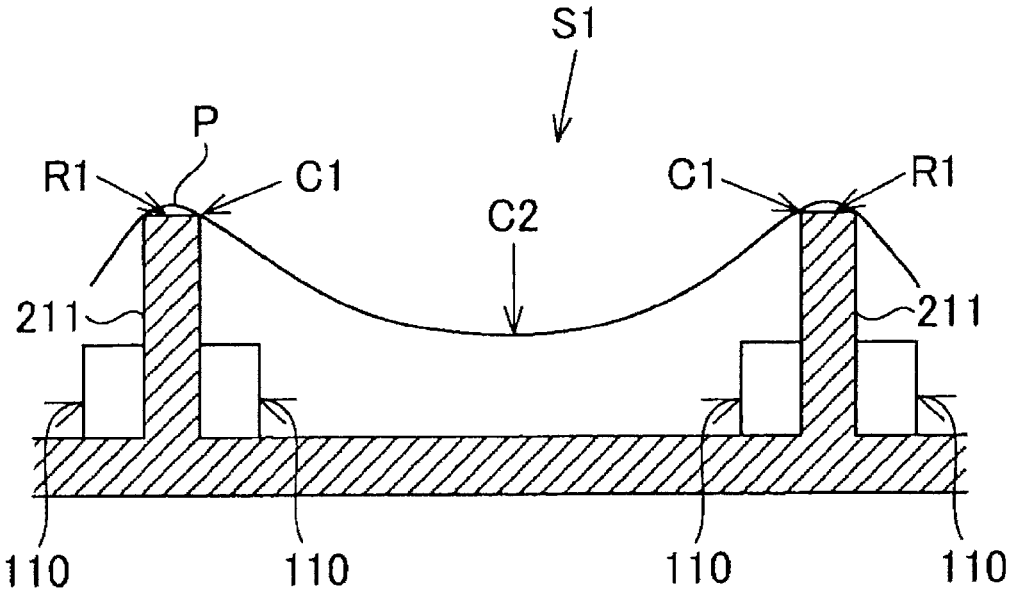
FIG. 9 is a diagram showing a print sheet bending downward on the discharge tray.

As shown in FIG. 9, a print sheet P discharged onto the discharge tray 21 is supported by top ends R1 of the ribs 211. As a result, contact parts C1 of the print sheet P where the print sheet P contacts the top ends R1 are at approximately the same height as the top ends R1. However, non-contact parts C2 of the print sheet P that are not supported by the top ends R1 are bent downward due to the self-weight of the print sheet P and enter the spaces S1. FIG. 9 shows an extreme example of a state where the non-contact parts C2 are bent and enter the spaces S1. However, when a print sheet P containing a substantial amount of water is used, or when a print sheet P is subjected to the fixing process under a high-humidity environment, the amount of bend may increase.

As described above, according to the present embodiment, the ventilation holes 110 are formed at positions facing the ends of the ribs 211 on the first vertical partition wall 101 side, wherein the width W1 of the ventilation holes 110 is larger than the width W2 of the ribs 211. With this configuration, even if the non-contact parts C2 of the print sheet P are bent downward due to the self-weight of the print sheet P, it does not happen that the ventilation holes 110 are closed by the non-contact parts C2 of the print sheet P.

As a result, it is possible to prevent the generation of air flow in the spaces S1 from being hindered by the closure of the ventilation holes 110 by the non-contact parts C2, and it is possible to cool the print sheets P and the discharge tray 21 in a reliable manner. It is further possible to prevent an adverse effect caused by the heat on the various optical parts such as the LSU 34 disposed below the discharge tray 21.

In addition, according to the present embodiment, the height L1 of the ventilation holes 110 is set lower than the height L2 of the ribs 211. On the other hand, in the case where the height L1 of the ventilation holes 110 is set higher than the height L2 of the ribs 211, when, in particular, a small number of sheets are stacked on the discharge tray 21, air above the stacked print sheets P is also sucked, and negative pressure necessary for generating air flow in the spaces S1 between the ribs 211 is not generated.

According to the present embodiment, since the height L1 of the ventilation holes 110 is set lower than the height L2 of the ribs 211, the negative pressure for generating air flow in the spaces S1 between the ribs 211 is generated in a reliable manner. However, it is preferable that the negative pressure, which presses the print sheets P toward the discharge tray 21, is not high enough to promote the downward bending of the non-contact parts C2.

In addition, according to the present embodiment, the air in the spaces S1 between the discharge tray 21 and the print sheets P placed thereon is taken (sucked) into the inside of the image forming apparatus 10. This allows the print sheets P on the discharge tray 21 to be cooled. This cooling method of the present embodiment has the following merits compared to a cooling method that realizes the cooling by taking air into the inside of the image forming apparatus 10 from a place that is different from the spaces S1 and exhausting the air to the discharge tray 21.

That is, according to the above-described method of cooling the print sheets P by exhausting the air to the discharge tray 21, the print sheets P stacked on the discharge tray 21 may float, change in posture, or move further toward the downstream side in the sheet discharge direction. In addition, if air is taken in from outside the apparatus main body via the exhaust outlet 112A, the air is to pass near the fixing portion 19, and in that case, the air is warmed to some extent. This reduces the cooling effect if the air is exhausted to the spaces S1 between the ribs 211.

On the other hand, according to the present embodiment, the air used to cool the print sheets P stacked on the discharge tray 21 is air that has not passed near the fixing portion 19 yet, and thus provides a high cooling effect. It should be noted however that the present disclosure does not exclude a configuration where the print sheets P are cooled by exhaust air.

Up to now, preferable embodiments of the present disclosure have been described. However, the present disclosure is not limited to the embodiments described so far, but allows application of various modifications.

For example, in the above-described embodiment, the ventilation holes 110, which have the width W1 that is larger than the width W2 of the ribs 211, are formed in the first vertical partition wall 101 such that the center in the width direction of each ventilation hole 110 correspond to the center in the width direction of a corresponding rib 211, thereby openings M are formed on both sides of each rib 211 in the width direction when the first vertical partition wall 101 is viewed from the rib 211 side (see FIG. 7). However, the present disclosure is not limited to this configuration. For example, the ventilation holes 110 may be formed such that an opening M is formed on a side of each rib 211 in the width direction.

Figure 10:
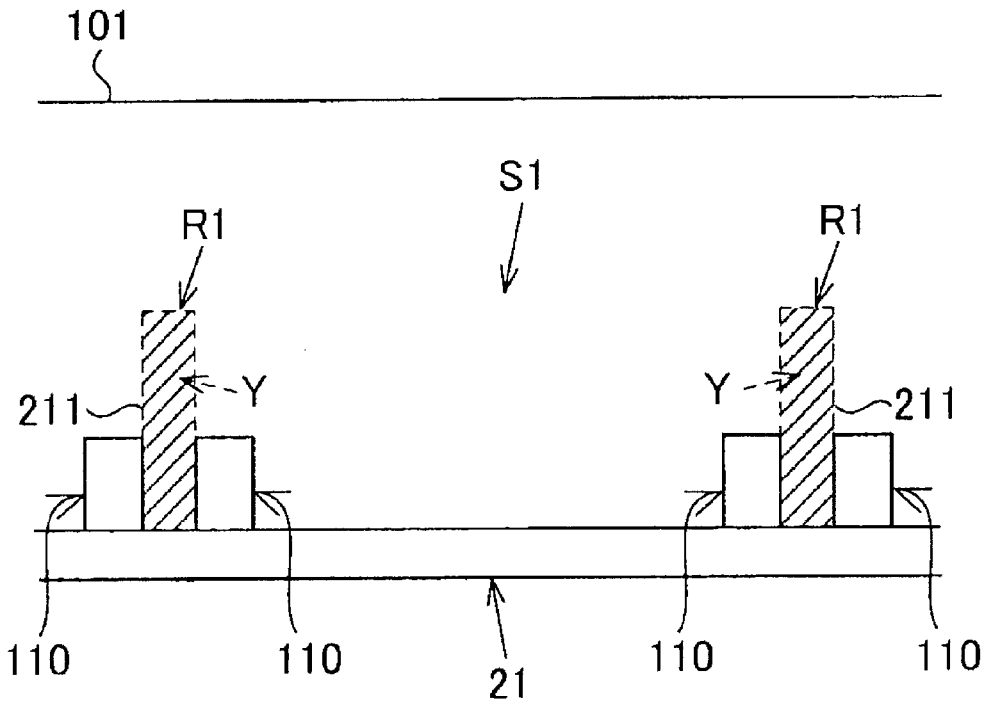
FIG. 10 is a diagram showing a modification of the ventilation holes.

As another example, instead of the configuration where the ventilation holes 110, which have the width W1 that is larger than the width W2 of the ribs 211, are formed in the first vertical partition wall 101, the configuration shown in FIG. 10 may be adopted. That is, in correspondence with each rib 211, a pair of rectangular ventilation holes 110 may be formed in the first vertical partition wall 101 to be separated from each other by the width of a corresponding rib 211, and the whole end 211A on the first vertical partition wall 101 side of the corresponding rib 211 may be joined with the solid part of the first vertical partition wall 101 between the pair of rectangular ventilation holes 110. In other words, rectangular ventilation holes 110 may be formed on both sides of the area Y of the first vertical partition wall 101 with which the corresponding rib 211 is to be joined.

Figure 11:
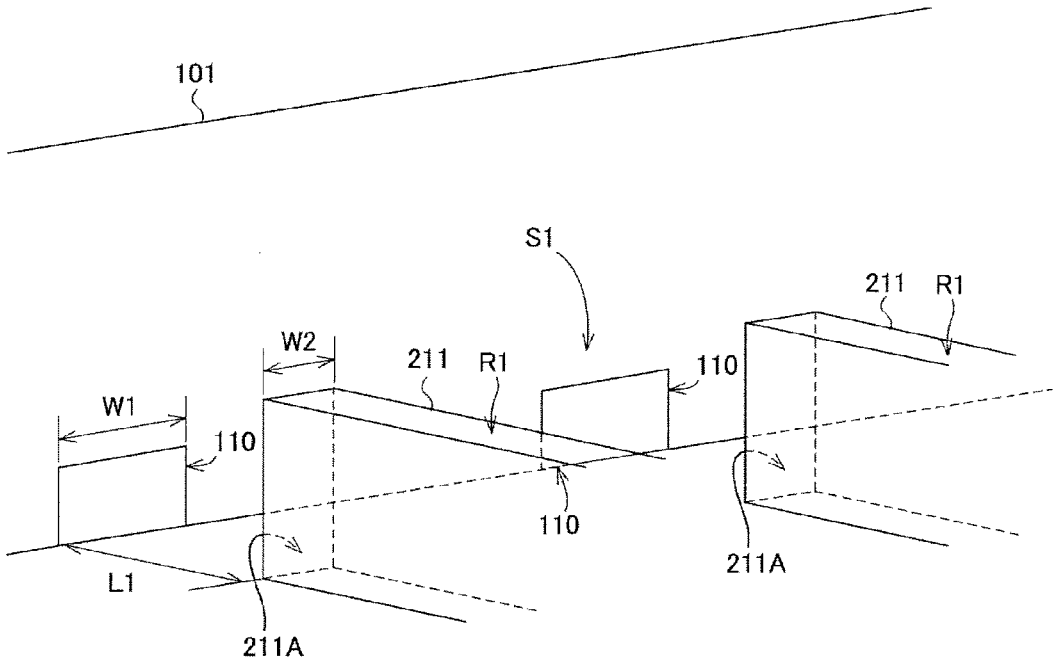
FIG. 11 is a perspective view showing a modification pertaining to the positional relationship between the ribs and the first vertical partition wall.
Figure 12:
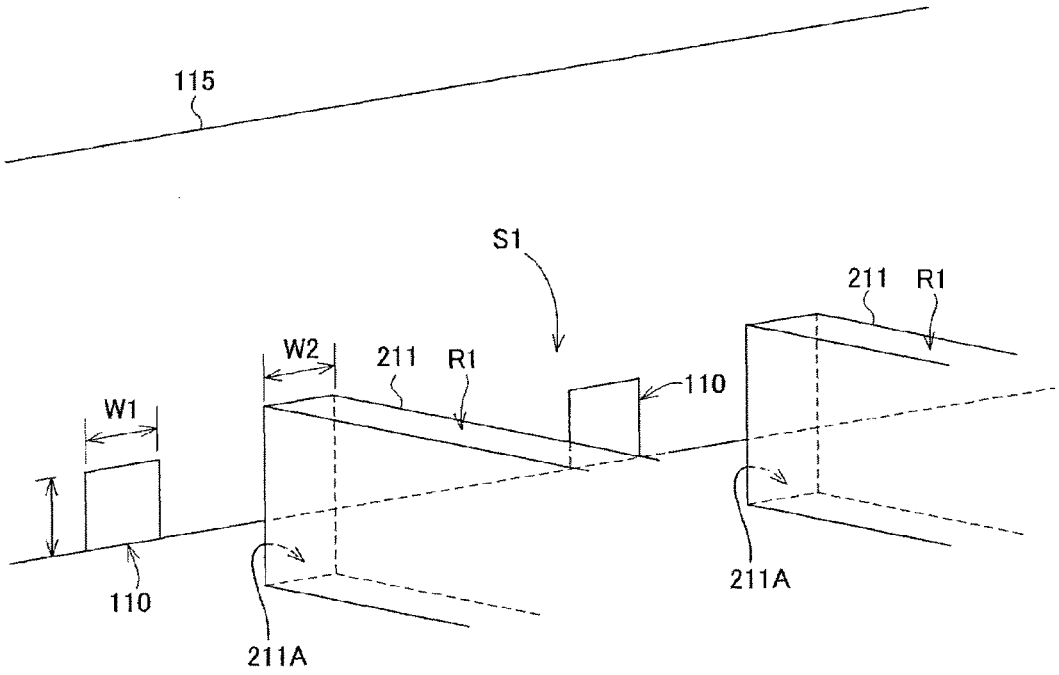
FIG. 12 is a perspective view showing another modification pertaining to the positional relationship between the ribs and the first vertical partition wall.

As a further example, the ribs 211 may not necessarily be joined with the first vertical partition wall 101 as in the above-described embodiment. As shown in FIG. 11, the ribs 211 and the first vertical partition wall 101 may be formed to face each other with a predetermined interval L1 therebetween. That is, the ventilation holes 110 may be formed at positions facing the ends of the ribs 211 on the first vertical partition wall 101 side. In that case, the width W1 of the ventilation holes 110 may be larger than the width W2 of the ribs 211, or may be, as shown in FIG. 12, set to be equal to or smaller than the width W2 of the ribs 211.

The air flow generating portion of the present disclosure is not limited to a fan, but may be configured to cool the print sheets P by a natural convection that is generated by using the thermal characteristic of the air where the higher in temperature the air is, the higher the air rises. For example, the air flow generating portion may be a ventilation hole (not shown) formed in the first horizontal partition wall 103. That is, the air in the ventilation duct 112 heated by the fixing portion 19 is naturally exhausted from the ventilation hole. This allows the air in the spaces S1 to be taken into the ventilation duct 112, thereby a natural convection is generated. Such natural convection may be used to cool the print sheets P.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a discharge tray on which a sheet having been subjected to a fixing process for thermally fixing a toner image on the sheet is discharged;

a plurality of ribs formed on the discharge tray;

a ventilation duct formed on a side of an end among opposite ends of each of the plurality of ribs;

a ventilation hole formed in a partition wall separating the ventilation duct from a sheet mounting area of the discharge tray, and formed in a vicinity of the end of each of the plurality of ribs on the partition wall side; and an air flow generating portion configured to generate, via the ventilation duct, air flow between outside of an apparatus main body and spaces between the ribs, wherein the ventilation hole is larger in width than each of the plurality of ribs, and the plurality of ribs are arranged such that, in each area of a surface of the partition wall including the ventilation hole in width direction thereof, the surface and the end of each of the plurality of ribs on the partition wall side are on a same plane.

2. The image forming apparatus according to claim 1, wherein the ventilation hole is smaller in height than each of the plurality of ribs.

3. An image forming apparatus comprising:

a discharge tray on which a sheet having been subjected to a fixing process for thermally fixing a toner image on the sheet is discharged;

a plurality of ribs formed on the discharge tray;

a ventilation duct formed on a side of an end among opposite ends of each of the plurality of ribs;

a ventilation hole formed in a partition wall separating the ventilation duct from a sheet mounting area of the discharge tray, and formed in a vicinity of the end of each of the plurality of ribs on the partition wall side; and an air flow generating portion configured to generate, via the ventilation duct, air flow between outside of an apparatus main body and spaces between the ribs, wherein the ventilation hole is larger in width than each of the plurality of ribs, and is formed to face the end of each of the plurality of ribs on the partition wall side, and the plurality of ribs are arranged such that a surface of the partition wall and the end of each of the plurality of ribs on the partition wall side are on a same plane.

4. An image forming apparatus comprising:

a discharge tray on which a sheet having been subjected to a fixing process for thermally fixing a toner image on the sheet is discharged;

a plurality of ribs formed on the discharge tray;

a ventilation duct formed on a side of an end among opposite ends of each of the plurality of ribs;

a ventilation hole formed in a partition wall separating the ventilation duct from a sheet mounting area of the discharge tray, and formed in a vicinity of the end of each of the plurality of ribs on the partition wall side; and an air flow generating portion configured to generate, via the ventilation duct, air flow between outside of an apparatus main body and spaces between the ribs, wherein the ribs are disposed such that the end of each of the plurality of ribs on the partition wall side is a distance away from a wall surface of the partition wall, and the ventilation hole is formed to face the end of each of the plurality of ribs on the partition wall side.

5. An image forming apparatus comprising:

a discharge tray on which a sheet having been subjected to a fixing process for thermally fixing a toner image on the sheet is discharged;

a plurality of ribs formed on the discharge tray;

a ventilation duct formed on a side of an end among opposite ends of each of the plurality of ribs;

a ventilation hole formed in a partition wall separating the ventilation duct from a sheet mounting area of the discharge tray, and formed in a vicinity of the end of each of the plurality of ribs on the partition wall side; and an air flow generating portion configured to generate, via the ventilation duct, air flow between outside of an apparatus main body and spaces between the ribs, wherein the end of each of the plurality of ribs on the partition wall side is joined with a wall surface of the partition wall, and the ventilation hole is formed adjacent to a part where the end of each of the plurality of ribs on the partition wall side is joined with the wall surface of the partition wall.

6. An image forming apparatus comprising:

a discharge tray on which a sheet having been subjected to a fixing process for thermally fixing a toner image on the sheet is discharged;

a plurality of ribs formed on the discharge tray;

a ventilation duct formed on a side of an end among opposite ends of each of the plurality of ribs;

a ventilation hole formed in a partition wall separating the ventilation duct from a sheet mounting area of the discharge tray, and formed in a vicinity of the end of each of the plurality of ribs on the partition wall side; and an air flow generating portion configured to generate, via the ventilation duct, air flow between outside of an apparatus main body and spaces between the ribs, wherein an optical scanning device is disposed below the discharge tray.

7. A discharge tray comprising:

a sheet mounting surface having a sheet mounting area on which a sheet having been subjected to a fixing process for thermally fixing a toner image on the sheet is placed;

a plurality of ribs formed on the sheet mounting surface;

a partition wall configured to separate the sheet mounting area from a ventilation duct formed on a side of an end among opposite ends of each of the plurality of ribs; and a ventilation hole formed in the partition wall in a vicinity of the end of each of the plurality of ribs on the partition wall side, wherein the ventilation hole is larger in width than each of the plurality of ribs, and the plurality of ribs are arranged such that, in each area of a surface of the partition wall including the ventilation hole in width direction thereof, the surface and the end of each of the plurality of ribs on the partition wall side are on a same plane.

8. The discharge tray according to claim 7, wherein the ventilation hole is smaller in height than each of the plurality of ribs.

9. A discharge tray comprising:

a sheet mounting surface having a sheet mounting area on which a sheet having been subjected to a fixing process for thermally fixing a toner image on the sheet is placed;

a plurality of ribs formed on the sheet mounting surface;

a partition wall configured to separate the sheet mounting area from a ventilation duct formed on a side of an end among opposite ends of each of the plurality of ribs; and a ventilation hole formed in the partition wall in a vicinity of the end of each of the plurality of ribs on the partition wall side, wherein the ventilation hole is larger in width than each of the plurality of ribs, and is formed to face the end of each of the plurality of ribs on the partition wall side, and the plurality of ribs are arranged such that a surface of the partition wall and the end of each of the plurality of ribs on the partition wall side are on a same plane.

10. A discharge tray comprising:

a sheet mounting surface having a sheet mounting area on which a sheet having been subjected to a fixing process for thermally fixing a toner image on the sheet is placed;

a plurality of ribs formed on the sheet mounting surface;

a partition wall configured to separate the sheet mounting area from a ventilation duct formed on a side of an end among opposite ends of each of the plurality of ribs; and a ventilation hole formed in the partition wall in a vicinity of the end of each of the plurality of ribs on the partition wall side, wherein the ribs are disposed such that the end of each of the plurality of ribs on the partition wall side is a distance away from a wall surface of the partition wall, and the ventilation hole is formed to face the end of each of the plurality of ribs on the partition wall side.

11. A discharge tray comprising:

a sheet mounting surface having a sheet mounting area on which a sheet having been subjected to a fixing process for thermally fixing a toner image on the sheet is placed;

a plurality of ribs formed on the sheet mounting surface;

a partition wall configured to separate the sheet mounting area from a ventilation duct formed on a side of an end among opposite ends of each of the plurality of ribs; and a ventilation hole formed in the partition wall in a vicinity of the end of each of the plurality of ribs on the partition wall side, wherein the end of each of the plurality of ribs on the partition wall side is joined with a wall surface of the partition wall, and the ventilation hole is formed adjacent to a part where the end of each of the plurality of ribs on the partition wall side is joined with the wall surface of the partition wall.

* * * * *